US005778454A

United States Patent [19]

Oxman

[11] Patent Number: 5,778,454

[45] Date of Patent: Jul. 14, 1998

[54] VISOR CAP

[75] Inventor: Scott E. Oxman, Chandler, Ariz.

[73] Assignee: Wind Wear Designs Partnership, Phoenix, Ariz.

[21] Appl. No.: 702,000

[22] Filed: Aug. 26, 1996

[51] Int. Cl.[6] ..... A42B 1/06

[52] U.S. Cl. ..... 2/195.1; 2/10; 2/12

[58] Field of Search ..... 2/12, 175.1, 195.1, 2/10

[56] References Cited

U.S. PATENT DOCUMENTS

| | | | |
|---|---|---|---|
| 1,412,479 | 4/1922 | Mayleas | 2/175.1 |
| 2,678,448 | 5/1954 | Rosenzweig | 2/195.1 |
| 2,874,387 | 2/1959 | Bannister et al. | 2/195 |
| 3,548,410 | 12/1970 | Parker | 2/3 |
| 3,927,421 | 12/1975 | Simon | 2/12 |
| 4,072,714 | 2/1978 | Ryder | 2/6 |
| 4,075,715 | 2/1978 | Cowgill | 2/6 |
| 4,320,919 | 3/1982 | Butler | 296/1 S |
| 4,354,285 | 10/1982 | Rudd | 2/424 |
| 5,091,995 | 3/1992 | Oates | 2/195 |
| 5,487,191 | 1/1996 | Ridley | 2/195 |

*Primary Examiner*—Diana Biefeld
*Attorney, Agent, or Firm*—Donald J. Lenkszus

[57] ABSTRACT

A visor construction and an attachment to a visor are described which makes unlikely the unintentional removal of the visor or cap to which the visor is attached by wind. The visor, in accordance with the invention, has a cross-section from its front edge to its rear edge which resembles an inverted airfoil.

11 Claims, 1 Drawing Sheet

VISOR CAP

FIELD OF THE INVENTION

This invention relates to headgear having a visor, in general, and to a visor device which lessens the likelihood that the headgear will be blown from the head of the wearer in high wind.

BACKGROUND OF THE INVENTION

There have been a variety of cap designs produced over the years for sports-minded participants. Many of these caps are of the very popular baseball-type, having a crown and an attached brim or visor, the visor usually made of a cloth material having an intermediate stiffener of cardboard or other semi-rigid or rigid material. Caps of this type are readily distinguished from hats, which usually have a continuous brim encircling the crown. More recently, visors have been made available which eliminate the crown portion of the cap and visor and use a strap which is attached to the visor and encircles the head of the wearer to secure the visor to the wearer's head. Thus, there are a variety of means to secure a visor to the wearer's head. The elongated visor or brim on the baseball-type caps or other articles is essential to provide maximum protection from the sun to the face of the user. Although the foregoing are effective in reducing glare and shielding the eyes of the wearer, they are very susceptible to being blown off of the wearer's head. That is, whenever wind pressure or air resistance, which is generated beneath the visor, is of sufficient intensity to produce upper movement on the visor, the cap is blown from the wearer's head. Thus, when the intensity of the wind or resistance of the air is of a force sufficient to remove the cap, the wearer must either hold it on his head, or if possible, pull it on so tightly that it causes discomfort, or take it off and hold it.

Attempts have been made to solve this problem. In U.S. Pat. No. 2,874,387, there is disclosed a visor cap in which the visor is provided with a series of transverse slats, with each slat provided with a vane which extends below the visor. Thus, a series of transverse slots are formed in the visor which form release vents for the wind pressure. In U.S. Pat. No. 5,091,995, the brim or visor is made of a flexible, open mesh material which is said to reduce the resistance to wind while still allowing the passage of filtered light. In U.S. Pat. No. 5,487,191, again, a visor cap is disclosed in which the visor is vented, thereby permitting a flow of air through the visor, precluding unintentional removal of the cap by wind currents.

BRIEF SUMMARY OF THE INVENTION

The present invention provides a novel visor construction for attachment to a cap or other article which precludes or makes unlikely the unintentional removal of the cap or article by wind forces. The visor construction of this invention does not utilize openings or vents in the visor to relieve air pressure as is rather common in the prior art caps noted previously. A visor in accordance with the principles of the invention, has a cross-section from its front edge back to its point of attachment to the cap which resembles an inverted airfoil or airplane wing. That is, the top or upper visor surface is relatively flat as is the visor on a regular baseball-type cap. However, the bottom or lower visor surface is shaped so that it is much more curved than its top surface. Such construction serves to increase the velocity of the wind and thereby reduces the pressure of the wind on the lower surface of the visor. Thus, along the upper surface of the visor, the wind pressure is greater, while in the area of the lower surface of the visor, although the velocity of the wind is increased, the pressure is reduced. It is this pressure differential between the upper and lower visor surfaces resulting from the unique construction of the visor, which makes it less likely that the cap will be unintentionally removed by wind.

A visor in accordance with the invention is constructed so that the forward edge of the visor resembles the leading edge of an airfoil, and is rounded and relatively thick. Proceeding from the forward edge of the visor to the rearward edge of the visor (trailing edge), the lower surface is curved so that the rearward edge is significantly thinner than the leading or forward edge. That is, the distance from the upper surface to the lower surface at the forward edge is greater than the distance from the upper surface to the lower surface at the rearward edge. Thus, air traveling across the lower surface of the visor travels faster, and its pressure on the lower surface is reduced, as compared to air pressure on the upper surface of the visor.

An off-the-shelf visor cap can be easily provided with the benefits of this invention by means of an airfoil-shaped device in accordance with the principles of the invention, which is readily attached to and can be removed from the visor. In a preferred embodiment, such device is provided with attachment means such as a spring clip, which permits the device to be easily attached to the lower side of the visor when needed, and then removed when not needed.

BRIEF DESCRIPTION OF THE DRAWINGS

The invention will be better understood from a reading of the following detailed description in conjunction with the drawing in which like reference indicators in the various Figures designate like elements and in which.

DESCRIPTION OF THE PREFERRED EMBODIMENTS

In the field of aeronautics, the upper surface of an airplane's wing is more curved than the lower surface and thus the wing serves as an airfoil. Thus, because of the airfoil design, air traveling across the wing is made to travel faster across the upper surface, and its pressure on the upper surface is reduced. The relatively greater pressure from beneath the wing on its relatively flat surface supplies the necessary lift or upward force to keep the airplane aloft.

Figure 1:
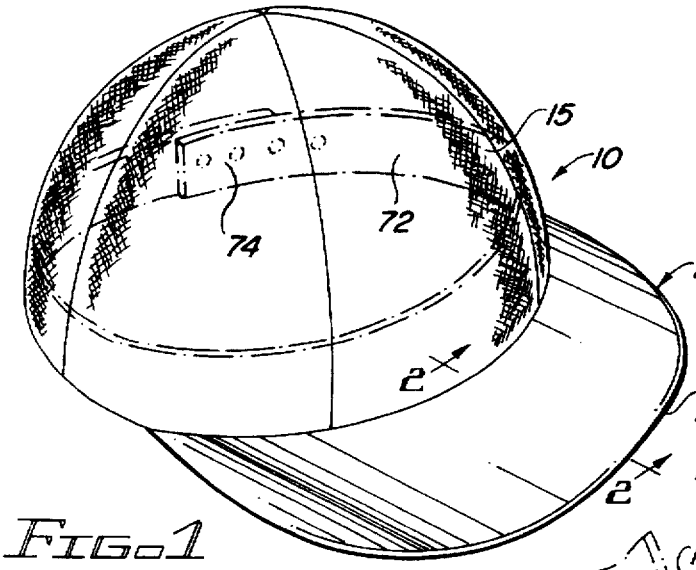
FIG. 1 is a perspective view of a visor cap according to the present invention.
Figure 3:
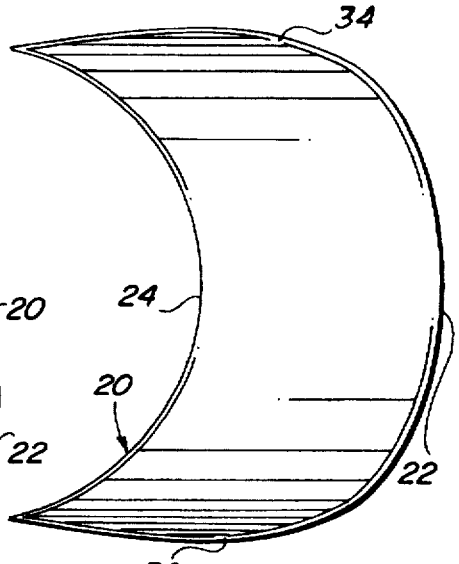
FIG. 3 is a top plan view of the visor portion of the visor cap shown in Fig. 1.
Figure 2:
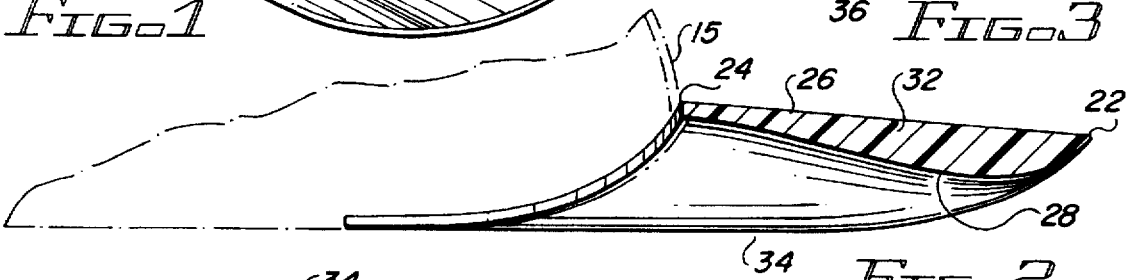
FIG. 2 is a cross-sectional view taken along the line 2—2 of FIG. 1.

With reference to the drawings, and particularly FIG. 1, a visor cap embodying the new concepts and principles of the present invention is designated generally by the reference numeral 10. More specifically, visor cap 10 comprises a central crown 15 with visor 20 extending from and attached to crown 15 and functioning to shield the wearer's eyes from direct sunlight and glare. As shown in FIG. 2, visor 20 has a top or upper surface 26, a lower surface 28, a leading or forward edge 22, a trailing or rearward edge 24, and side edges 34 and 36. Both the leading and trailing edges are arcuate-shaped, in the case of the trailing edge so that it mates with the circular-shaped crown.

Figure 4:
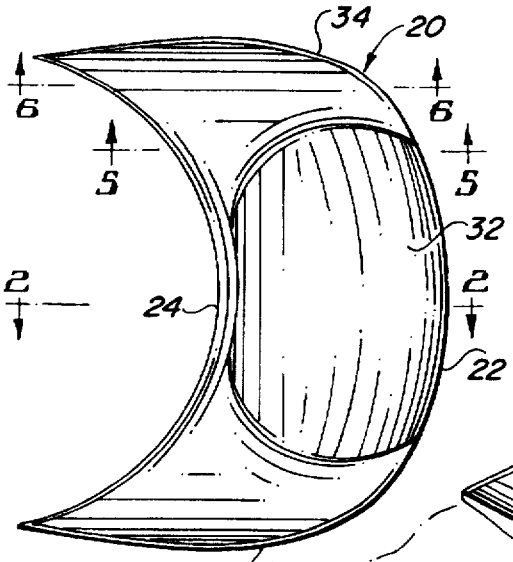
FIG. 4 is a view of the lower side of the visor shown in FIG. 3.
Figure 5:
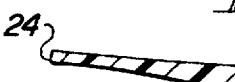
FIG. 5 is a cross-sectional view taken along the line 5—5 of FIG. 4.
Figure 6:
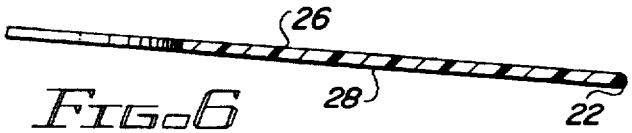
FIG. 6 is a cross-sectional view taken along the line 6—6 of FIG. 4.

FIG. 2 is a cross-sectional view of visor 20 taken on a line which is about midway between visor sides 34 and 36. As shown in FIG. 2, visor area 32 of visor 20 is so constructed as to resemble and function as an inverted airfoil or airplane wing. That is, the forward edge 22 of visor area 32 is rounded and relatively thick, much like the leading edge of an airfoil or airplane wing. As one proceeds from edge 22 towards trailing edge 24 of the visor, the visor area 32 becomes thinner so that the rearward edge or trailing edge is significantly thinner than the leading edge. It should be noted that the upper surface 26 of the visor is relatively flat just like a conventional visor on a cap, and this flat surface should be compared to the curved lower surface 28. In essence then, upper surface 26 is much like the lower surface of an airplane wing and, hence, is an area of reduced velocity of air and increased air pressure. Curved lower surface 28 is much like the upper surface of an airplane wing and is an area of increased air velocity and therefore reduced air pressure. It is this pressure differential between the upper surface 26 and lower surface 28 which gives rise to a downward force on the visor which substantially reduces the likelihood of the removal of the cap by wind forces. As shown in FIG. 5, the thickness of area 32 is gradually reduced as it approaches side edges 34 and 36. As shown in FIG. 6, both surfaces of visor 20 are relatively flat near the side edges 34 and 36. The visor area 32 occupies a rather substantial portion of the area of visor 20 and, as shown in FIG. 4, this area extends from the front edge 22 of the visor to a point almost to the rearward edge 24 of the visor.

As earlier noted, there are other ways of securing a visor to a wearer's head than by means of the crown portion of a visor cap. As shown in FIG. 1, crown 15 may be eliminated. In its place, a flexible strap is attached to the rearward edge 24 of visor 20. The strap 72 encircles the wearer's head, and the ends of the strap 72 are provided with means for securing the straps together. As shown, one of the ends of the strap has a series of circular openings 74. The other end of strap 72 has a series of pegs (not shown) which can engage with openings 74 to secure the strap ends together and thus secure visor 20 to a wearer's head.

Figure 7:
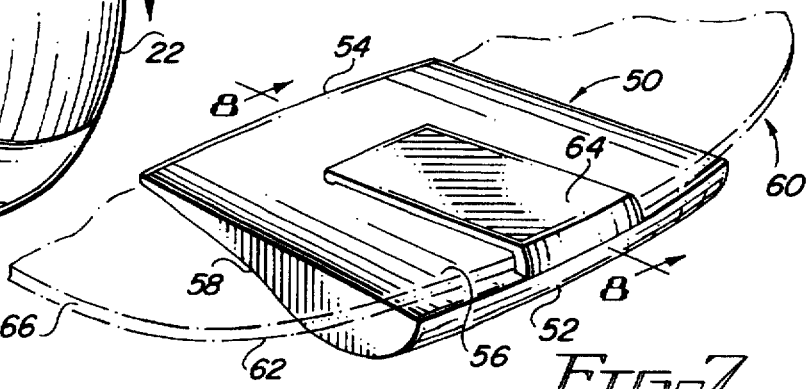
FIG. 7 is a partial perspective view of a visor provided with a further embodiment of the present invention.
Figure 8:
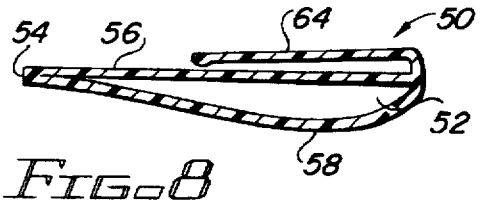
FIG. 8 is a cross-sectional view taken along the line 8—8 of FIG. 7.

FIG. 7 is a view of a device which is constructed to be attached to the visor 60 of a conventional baseball-type cap and obtain the benefits of this invention. As shown, device 50 is airfoil shaped having a relatively flat upper surface 56 and a curved lower surface 58. Forward edge 52 is rounded and relatively thick, very much like the leading or forward edge of visor 20 shown in FIGS. 1–6. As one proceeds towards the rearward or trailing edge 54, the device becomes considerably thinner. To save weight, the interior 82 of device 50 is hollow. Means for attaching device 50 to a conventional visor 60 are supplied, and in this specific embodiment, a spring clip 64 is attached to the top surface 56 in the area of forward or leading edge 52. A shoulder 55 engages the leading edge 63 of the visor 60. As shown in FIG. 7, the device may be easily attached to visor 60 by means of spring clip 64.

When properly attached to the visor, device 50, other than spring clip 64, is positioned immediately beneath visor 60 so that the relatively flat upper surface 56 is just below the lower surface 62 of the visor. When in position, curved lower surface 58 functions in the same manner as curved lower surface 28 of the visor shown in FIGS. 1–6. That is, air traveling across the visor travels faster across surface 58 than upper surface 66 of visor 60 and air pressure is reduced as compared to air pressure on the upper surface 66 of visor 60, greatly reducing the likelihood that the cap will be blown off the wearer's head.

The visor should be constructed of a relatively rigid material and a plastic such as polyethylene works very well. The visor can be molded as a one-piece item incorporating the special airfoil area.

To demonstrate the effectiveness of the improved visor cap of this invention, tests were conducted in a subsonic closed-circuit wind tunnel. Two visor caps were tested. One was a baseball-type cap purchased in the marketplace. The other cap was identical except it was fitted with the visor of this invention. Both caps were tested on the head of an individual so as to provide a realistic air flow about the cap and visor. The individual was positioned in the wind tunnel and the position of the cap on the wearer's head was adjusted so that in most tests the angle of the visor of the cap to the air flow was about −17°. This angle is called the angle of attack and is considered a normal position. The tension in the band adjustment of each cap was set exactly the same to provide the same tension on the wearer's head for each cap.

The caps were tested at various air speeds and for different angles of attack and yaw angles. Yaw angle is defined as the angle between the center line of the visor of the cap and the air flow. For most of the tests, the yaw angle was 0°, although this was varied in several tests up to an angle of 45°.

Table 1 summarizes the results which were obtained for the cap fitted with the visor of the invention.

TABLE 1

| Test No. | Angle of Attack | Yaw Angle | Range of Air Speed | Results |
|---|---|---|---|---|
| 1 | −17° | 0° | 0–30 mph | No motion of cap |
| 2 | −17° | 0° | 0–50 mph | No motion of cap |
| 3 | −22° to −12° | 0° | 0–70 mph | Cap remained in place |
| 4 | −17° | 0° | 0–79 mph | Cap remained in place |
| 5 | −17° | 0° | 0–78 mph | Cap remained in place |
| 6 | −5° | 0° | 0–30 mph | No motion of cap |
| 7 | −5° | 0° | 0–50 mph | Cap remained in place until wind speed exceeded 50 mph |
| 8 | Repeat of Test 7 - results the same; | | | |
| 9 | −17° | 22° | 0–30 mph | No motion of cap |
| 10 | −17° | 45° | 0–30 mph | No motion of cap |
| 11 | −17° | 0° to 45° | 0–70 mph | Cap remained in place |

Table 2 summarizes the test results for a conventional cap with an unmodified visor.

TABLE 2

| Test No. | Angle of Attack | Yaw Angle | Range of Air Speed | Results |
|---|---|---|---|---|
| 12 | −17° | 0° | 0–25 mph | Cap was removed at 25 mph |
| 13 | Test 12 repeated with the same results | | | |
| 14 | −17° | 0° | 0–32 mph | Tension of band of cap increased; cap removed at 32 mph |
| 15 | 17° | 0° | 0–35 mph | Tension of band of cap increased; cap removed at 35 mph |

It is readily apparent from a comparison of the tests in Table 1 and Table 2 that the visor of the invention significantly out performed the conventional cap.

Those skilled in the art will appreciate that various changes and modifications may be made to the embodiments which are shown and described without departing from the spirit or scope of the invention. It is intended that the invention be limited in scope only by the claims appended hereto.

I claim:

1. A cap comprising:

a crown;

a visor extending from said crown, said visor comprising an upper surface and a lower surface, a forward edge and a rearward edge, said rearward edge attached to said crown, said upper and lower surfaces extending between said forward and rearward edges, at least a portion of said visor having a cross-sectional shape formed by said upper and lower surfaces in the shape of an inverted air foil such that air traveling across said lower surface of said visor portion travels faster than air traveling across said upper surface of said visor portion, said lower surface being curved relative to said upper surface such that the cross sectional thickness of said visor portion between said upper surface and said lower surface proximate said forward edge is substantially greater than the cross-sectional thickness of said visor portion between said upper surface and said lower surface proximate said rearward edge.

2. A cap in accordance with claim 1, wherein:

said inverted air foil portion causes an air pressure differential between said upper and lower surface in the presence of wind impinging on said visor.

3. A cap in accordance with claim 2, wherein:

said lower surface is a region of reduced air pressure relative to said upper surface in the presence of wind.

4. A cap in accordance with claim 3, wherein:

said upper surface in at least said portion is substantially flat; and said lower surface of said visor in said portion has a curved shape such that the portion of said visor adjacent said forward edge of said portion is thicker than said portion adjacent said rearward edge.

5. A cap in accordance with claim 4, wherein:

said portion is so constructed such that said forward edge is rounded and said upper surface is spaced apart from said lower surface proximate said forward edge a substantially greater distance than said upper surface is spaced apart from said lower surface proximate said rearward edge.

6. A visor comprising:

a forward edge, a rearward edge, an upper surface and a lower surface, said upper surface and said lower surface both extending between said forward and rearward edges; and at least a portion of said visor having a cross-sectional shape formed by said upper and lower surfaces in the shape of an inverted airfoil such that air traveling across said lower surface of said visor portion travels faster than air traveling over said upper surface of said visor portion, said lower surface being curved relative to said upper surface such that the cross-sectional thickness of said visor portion between said upper surface and said lower surface proximate said forward edge is substantially greater than the cross-sectional thickness of said visor portion between said upper surface and said lower surface proximate said rearward edge.

7. A visor in accordance with claim 6, wherein:

said inverted airfoil shaped portion causes an air pressure differential between said upper and lower surface portions in the presence of wind impinging upon said visor.

8. A visor in accordance with claim 7, wherein:

said lower surface is a region of reduced air pressure relative to said upper surface.

9. A visor in accordance with claim 8, wherein:

said upper surface in at least said portion is substantially flat; and said lower surface of said visor in said portion is of curved shape such that a portion of said visor adjacent said forward edge of said portion is thicker than said portion adjacent said rearward edge.

10. A visor in accordance with claim 9, wherein:

said portion is so constructed such that said forward edge is rounded and said upper surface is spaced apart from said lower surface proximate said forward edge a substantially greater distance than said upper surface is spaced apart from said lower surface proximate said rearward edge.

11. A visor in accordance with claim 6, comprising:

a strap for encircling a wearer's head.

* * * * *